US007637776B2

(12) United States Patent
McNutt et al.

(10) Patent No.: US 7,637,776 B2
(45) Date of Patent: Dec. 29, 2009

(54) COMMUNICATION CABLING WITH SHIELDING SEPARATOR SYSTEM AND METHOD

(75) Inventors: Patrick S. McNutt, Carnation, WA (US); Bryan L. Sparrowhawk, Monroe, WA (US); Franklin C. Marti, Clinton, WA (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 45 days.

(21) Appl. No.: 11/750,310

(22) Filed: May 17, 2007

(65) Prior Publication Data

US 2007/0275583 A1 Nov. 29, 2007

Related U.S. Application Data

(60) Provisional application No. 60/800,958, filed on May 17, 2006.

(51) Int. Cl.
*H01R 13/648* (2006.01)

(52) U.S. Cl. ..... 439/607.05; 174/113 R

(58) Field of Classification Search ..... 174/113 R, 174/116, 113 C; 439/676, 608, 607.05
See application file for complete search history.

(56) References Cited

U.S. PATENT DOCUMENTS

| | | | | |
|---|---|---|---|---|
| 5,952,615 | A * | 9/1999 | Prudhon | 174/113 C |
| 7,332,676 | B2 | 2/2008 | Sparrowhawk | |
| 7,335,837 | B2 | 2/2008 | Pfeiler | |
| 2008/0264670 | A1 | 10/2008 | Glew | |

* cited by examiner

*Primary Examiner*—Felix O Figueroa
(74) *Attorney, Agent, or Firm*—Davis Wright Tremaine LLP; George C. Rondeau, Jr.; Heather M. Colburn

(57) ABSTRACT

A communication cabling includes a shielding separator having an elongated center member extending along a dimensional length, and a plurality of elongated dividing members each extending along the dimensional length and extending from the elongated center member. The dividing members may have at least a portion being of an electrically conductive material and others may have conductive material layers adjacent thereto.

30 Claims, 8 Drawing Sheets

COMMUNICATION CABLING WITH SHIELDING SEPARATOR SYSTEM AND METHOD

CROSS REFERENCE TO RELATED APPLICATION

This application claims priority benefit of provisional application Ser. No. 60/800,958 filed May 17, 2006, the content of which is incorporated in its entirety.

BACKGROUND OF THE INVENTION

1. Field of the Invention

The present invention is directed generally to communication cabling.

2. Description of the Related Art

Communication cabling typically contains multiple wires dedicated to different circuits and devices. For instance, a communication cable can have multiple pairs of wires each pair being used for different communication functions. In order to reduce signal interference from occurring between these wire pairs, conventional approaches include wrapping the wire pairs with metal foil or wire braid, which unfortunately can involve additional assembly, material costs, and cable stiffness.

BRIEF DESCRIPTION OF THE SEVERAL VIEWS OF THE DRAWING(S)

DETAILED DESCRIPTION OF THE INVENTION

Figure 1:
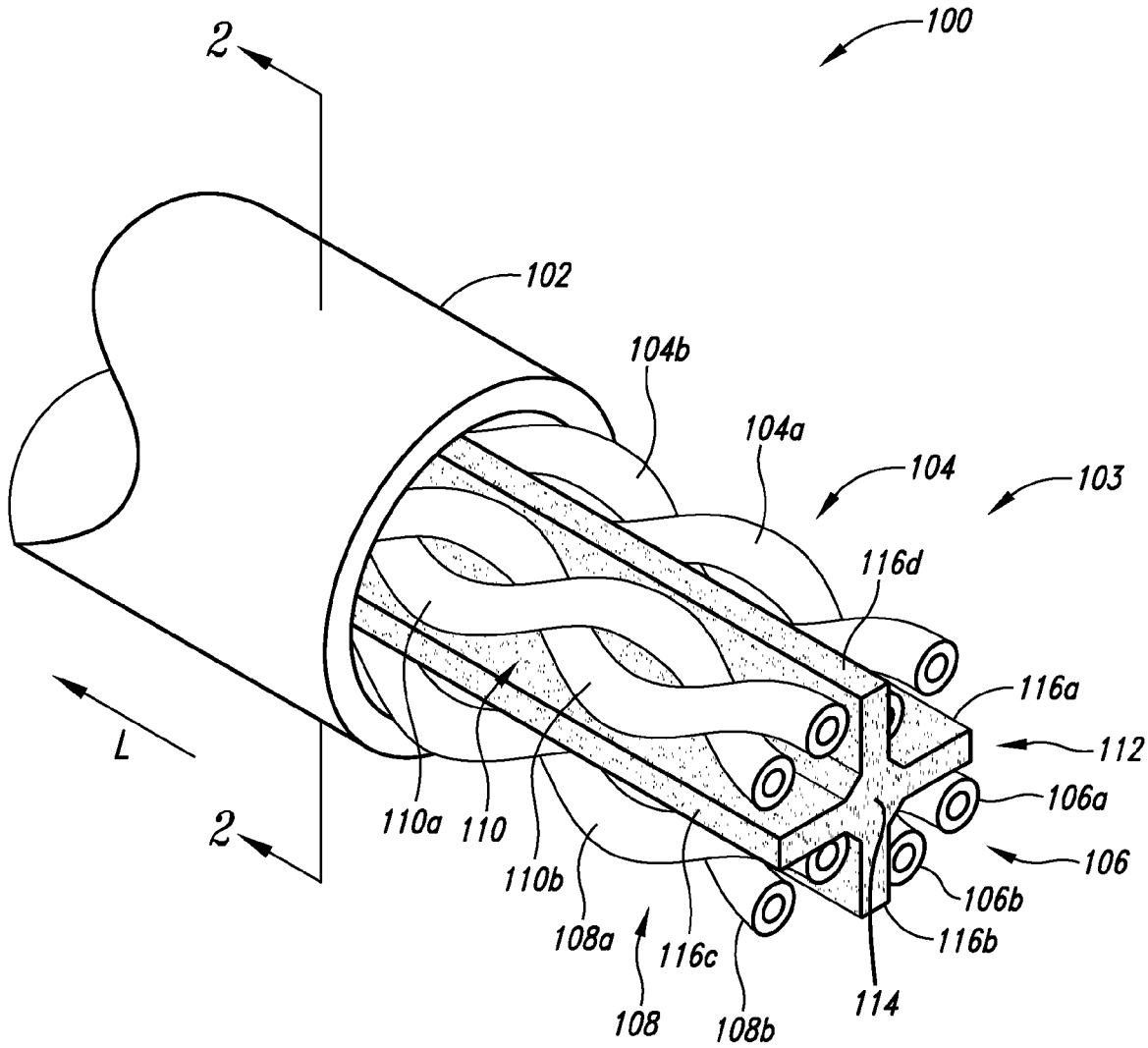
FIG. 1 is a sectional perspective view of a portion of a communication cabling system having a first implementation of a shielding separator.

As will be discussed in greater detail herein, a cabling system has a shielding separator having potions of conductive plastic to shield wire pairs of a communication cabling from one another to reduce possible signal interference between the wire pairs. Implementations of the shielding separator depicted in the drawings and described below have an elongated center member with four elongated members extending therefrom to form an elongated cross or "X" structure when viewed in cross-section transverse.

Various implementations depicted conductive plastic material in various locations of the elongated "X" structure as further described below. Although the implementations have taken the form of an elongated "X" structure to shield four wire pairs from one another, other implementations can have other shapes either to also shield four wire pairs or to shield another number of wire pairs such as six wire pairs, etc.

A communication cabling system 100 having a length dimension, L, is shown in FIG. 1 to include a sheathing 102 containing four wire pairs 103 comprising a first wire pair 104 having a first wire 104*a* and a second wire 104*b*, a second wire pair 106 having a first wire 106*a* and a second wire 106*b*, a third wire pair 108 having a first wire 108*a* and a second wire 108*b*, and a fourth wire pair 110 having a first wire 110*a* and a second wire 110*b*. The four wire pairs 103 are physically divided from one another by a shielding separator 112 that extends the length dimension, L, of the cabling system 100 along with the four wire pairs.

The shielding separator 112 includes an elongated center member 114 extending along the dimensional length, L. Radially extending outward from the center member 114 are four elongated dividing members 116 including a first elongated divider 116*a* that separates the first wire pair 104 from the second wire pair 106, a second elongated divider 116*b* that separates the second wire pair 106 from the third wire pair 108, a third elongated divider 116*c* that separates the third wire pair 108 from the fourth wire pair 110, and a fourth elongated divider 116*d* that separates the fourth wire pair 110 from the first wire pair 104.

Figure 2:
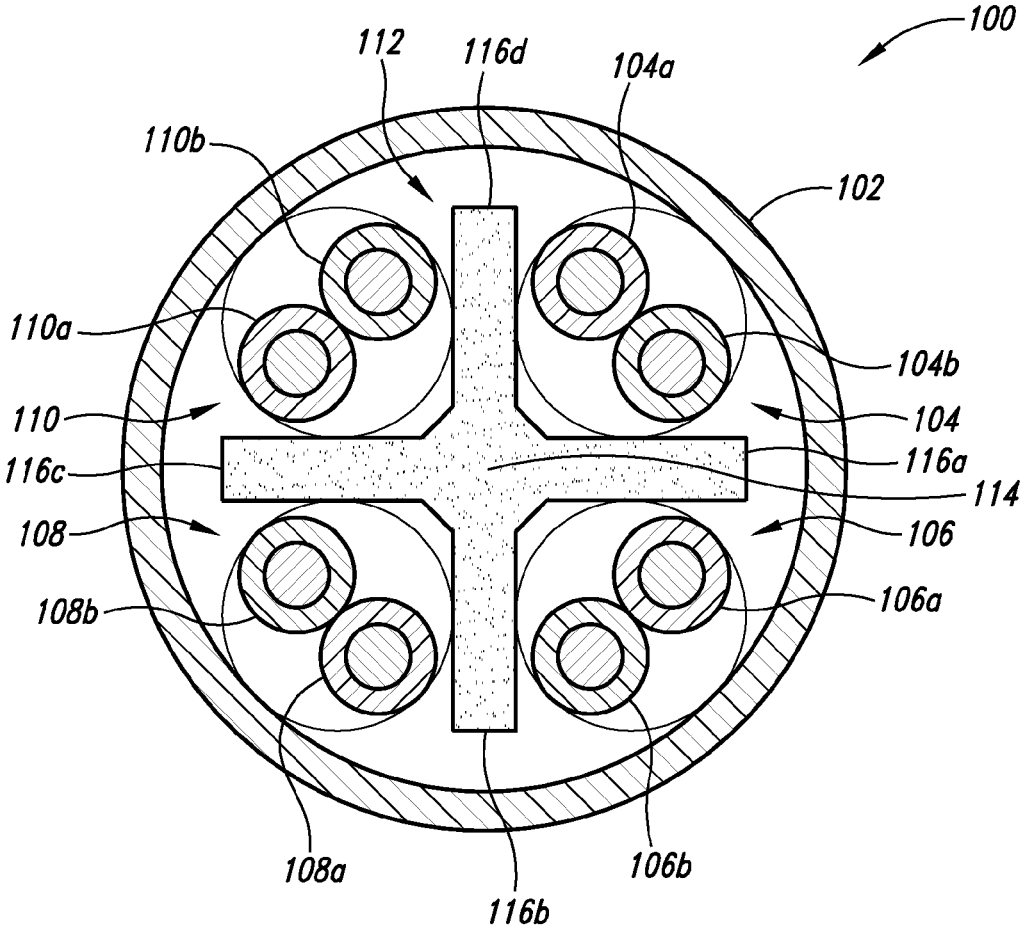
FIG. 2 is a cross-sectional view of the communication cabling system having the first implementation of the shielding separator taken along the 2-2 line of FIG. 1.
Figure 3:
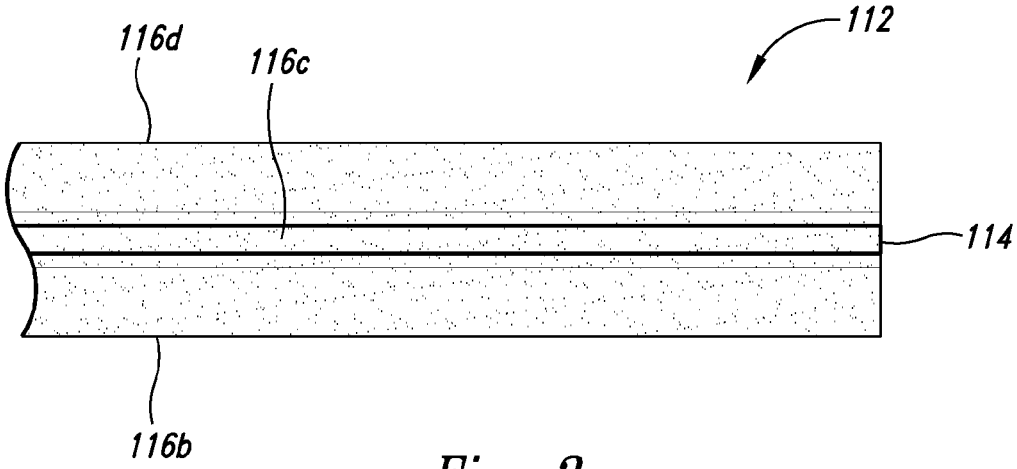
FIG. 3 is a side elevational view of a section of the first implementation of the shielding separator of FIG. 1.

A first implementation of the shielding separator 112 is shown in FIGS. 1-3 with the dividing members 116 extending longitudinally along the elongated center member 114 and formed integral therewith, with each dividing member projecting laterally outward from the elongated center member. The shielding separator 112 has a uniform material construction. All along the dimensional length, L, the elongated center member 114 and the elongated dividing members 116, that can be co-extruded, are made from electromagnetic shielding material (as indicated in the Figures by stippled marking) that, among other things, greatly reduces radio frequency waves from passing therethrough. For instance, in the first implementation, the shielding separator 112 can be of a conductive plastic material such as made from an extruded plastic that is impregnated with metal fibers or other electrically conductive material.

Figure 4:
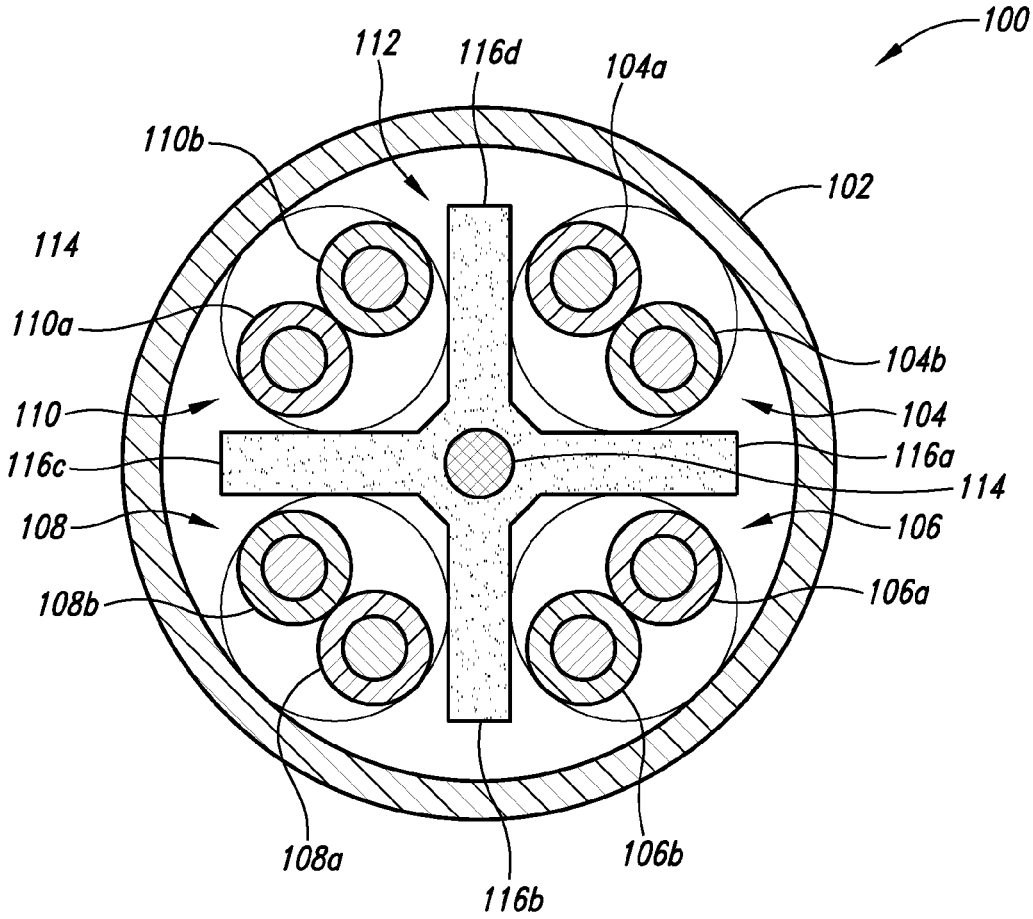
FIG. 4 is a cross-sectional view of a communication cabling system having a second implementation of a shielding separator.
Figure 5:
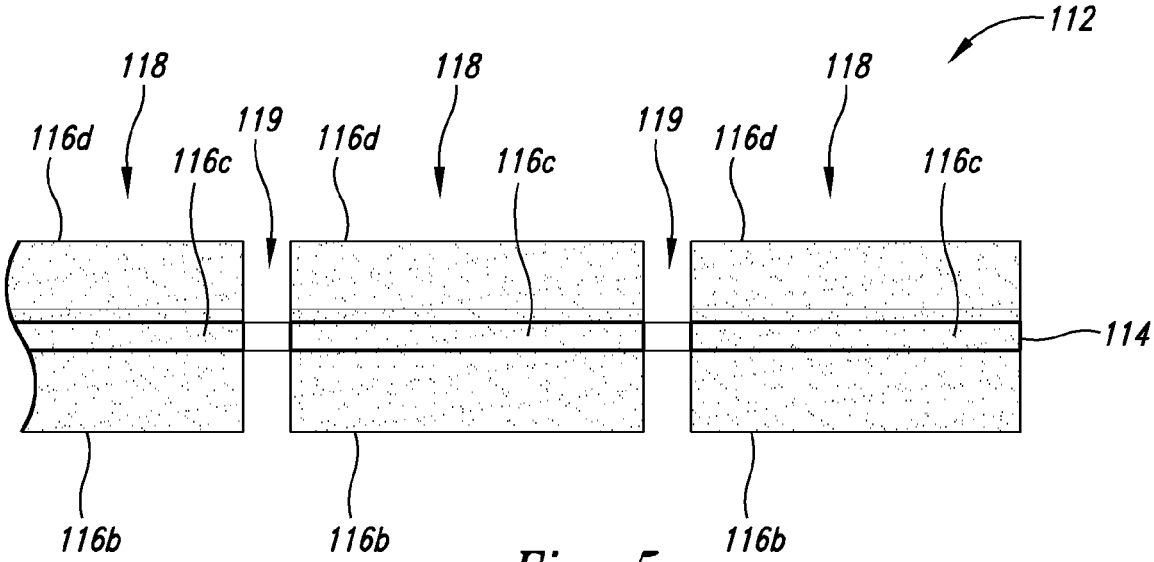
FIG. 5 is a side elevational sectional view of a section of the second implementation of the shielding separator of FIG. 4.

A second implementation of the shielding separator 112 is shown in FIGS. 4-5 in which the elongated center member 114 is of non-conductive material (as indicated in the Figures by hatched marking) and the elongated dividing members 116 are made from electromagnetic shielding material. The elongated center member 114 is shown in FIG. 5 as being continuous whereas the elongated dividing members 116 are shown to be part of divider sections 118 separated by gaps 119. In the second implementation, the conductive material is not one continuous length to prevent the shielding separator 112 from resonating like an antenna at frequencies such as from 1 MHz to 1 GHz.

Although the divider sections 118 are separated by gaps 119, the elongated non-conductor center member 114 allows the shielding separator 112 to remain as a continuous piece for ease of handling. As with the first implementation, the elongated center member 114 and the elongated dividing members 116 can be co-extruded to form co-extruded member portions of a single member with the elongated center member and the elongated dividing members being formed as an integral unit. Alternatively, other assembly techniques can be used such as cutting the elongated dividing members 116 into the divider sections 118 during assembly.

Figure 6:
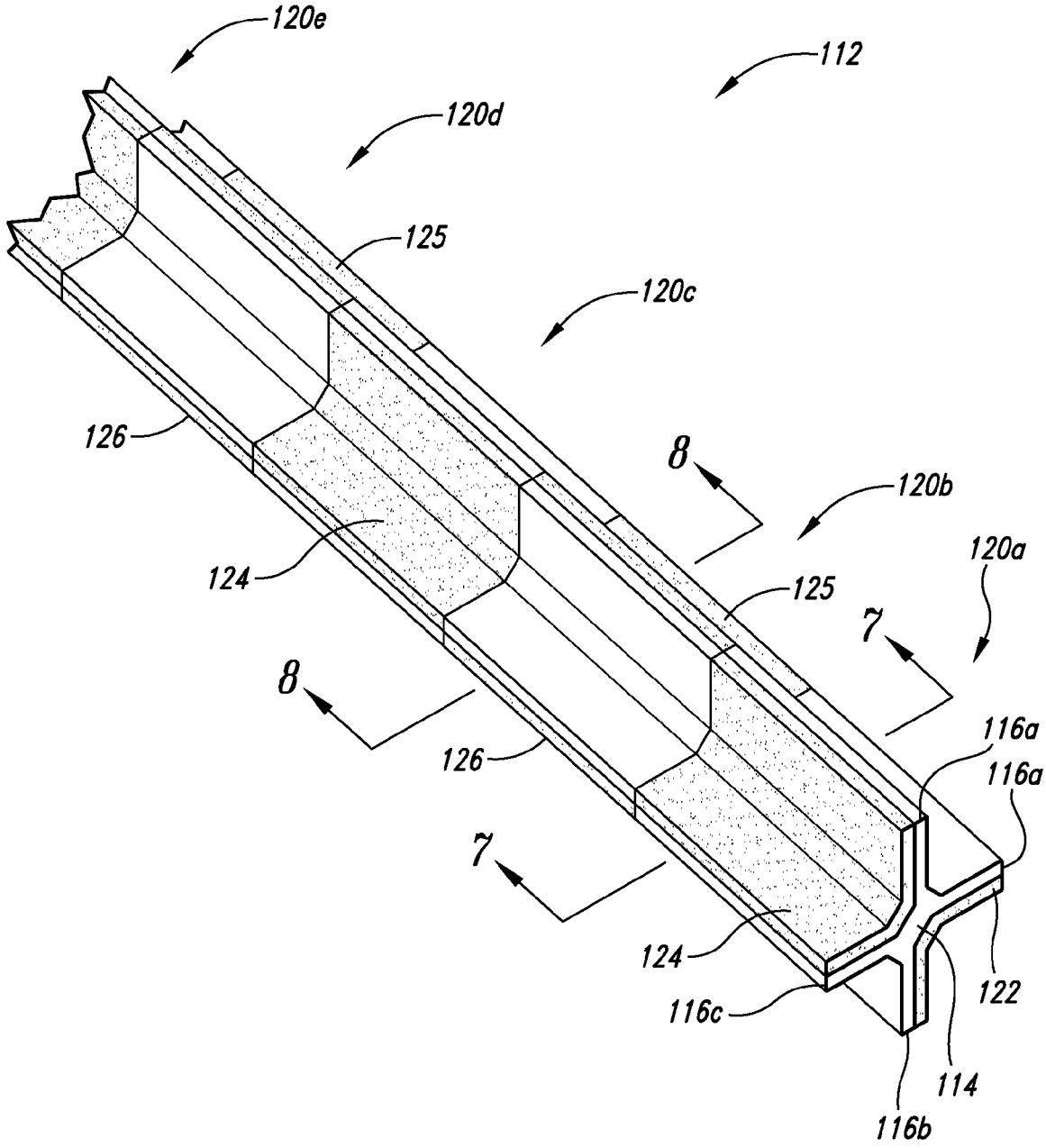
FIG. 6 is a perspective view of a section of a third implementation of a shielding separator.
Figure 7:
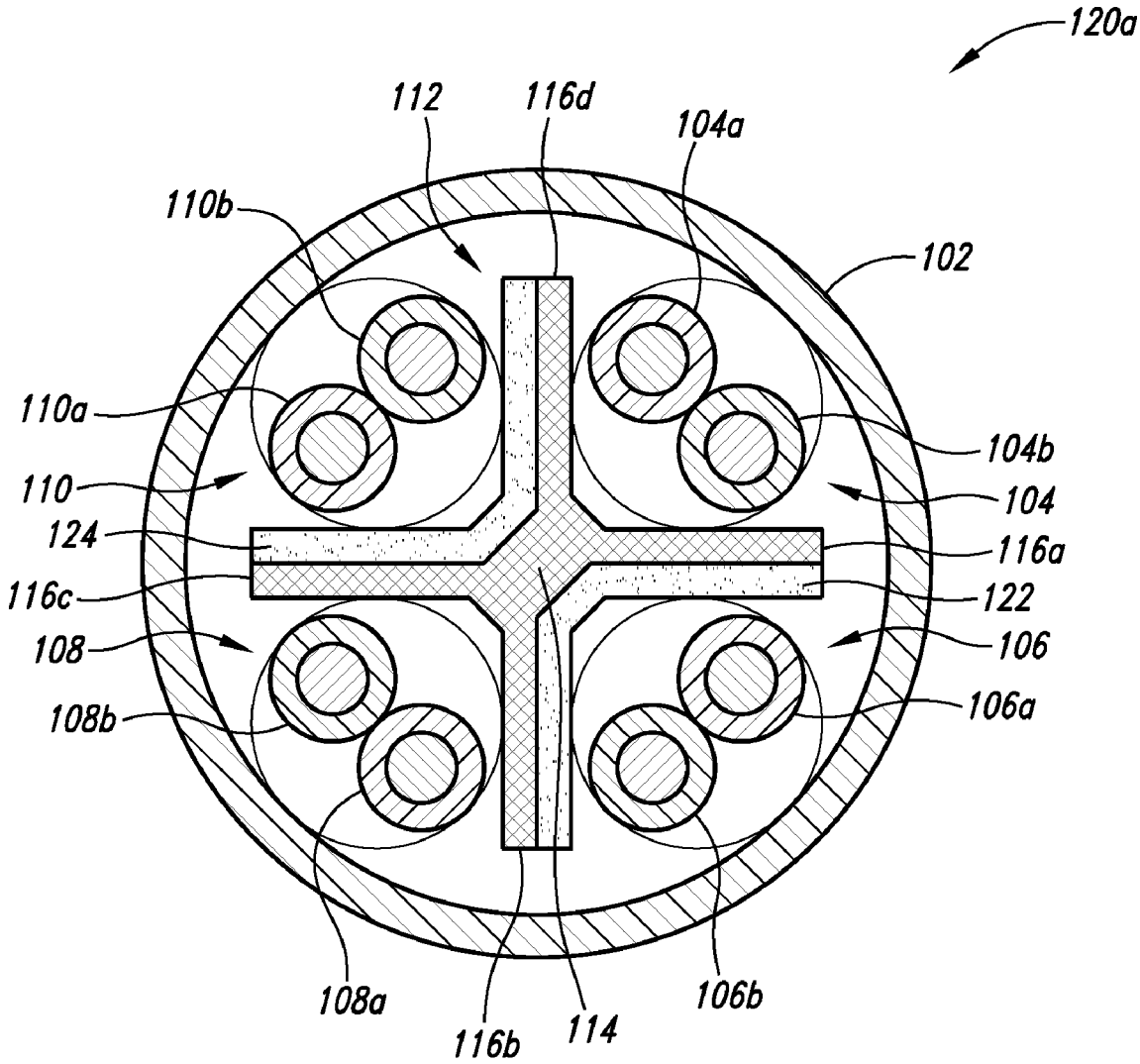
FIG. 7 is a cross-sectional view of a communication cabling system having the third implementation of the shielding separator showing the shielding separator cross-sectioned along the 7-7 line of FIG. 6.
Figure 8:
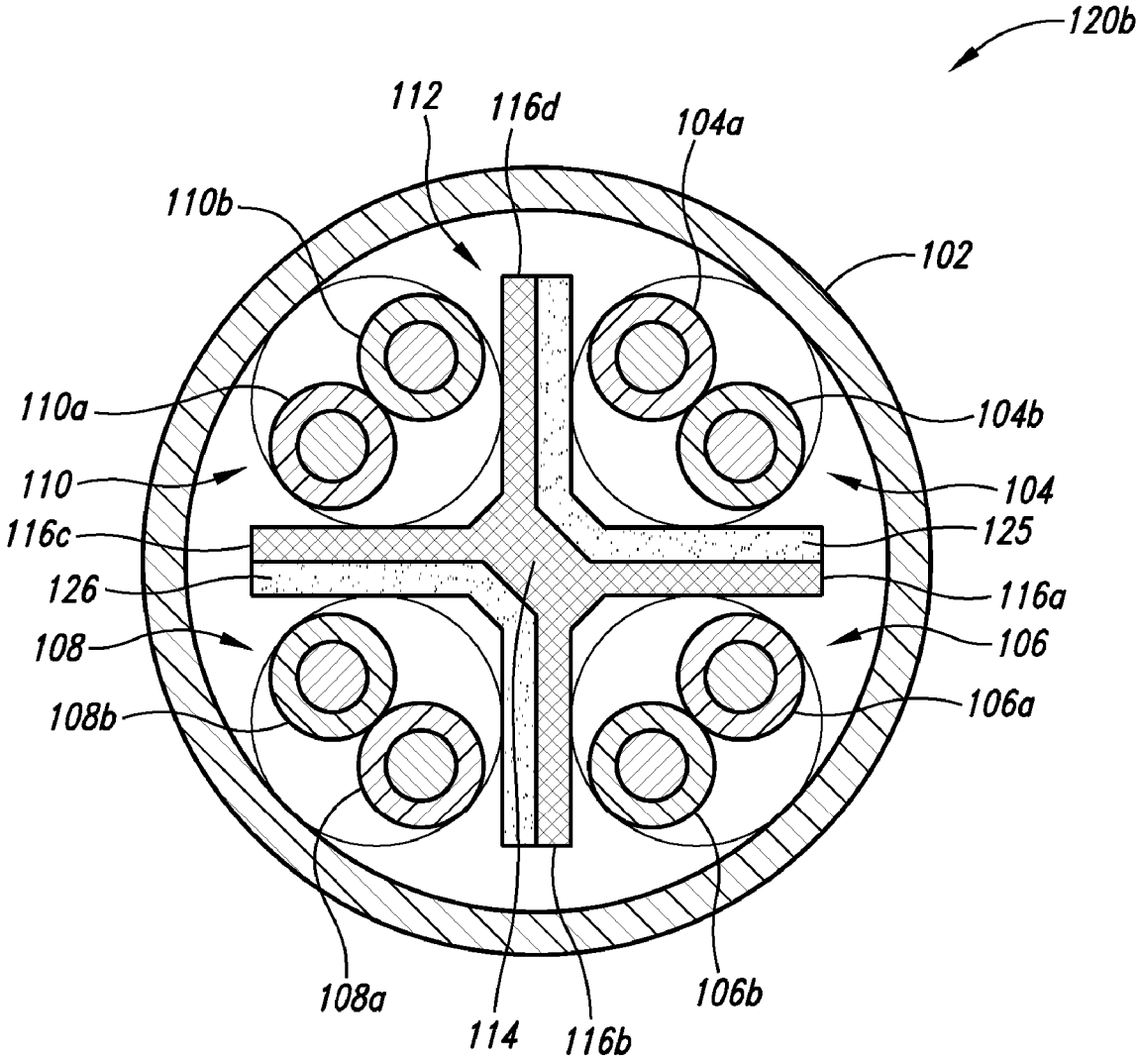
FIG. 8 is a cross-sectional view of the communication cabling system having the third implementation of the shielding separator showing the shielding separator cross-sectioned along the 8-8 line of FIG. 6.

A third implementation of the shielding separator 112 is shown in FIGS. 6-8 as having the elongated center member 114 and the dividing members 116 made from a non-conductive material such as non-conductive plastic. The shielding separator 112 is divided into sections 120(*a-e*) as shown in FIG. 6 to include a first section 120*a*, a second section 120*b*, a third section 120*c*, a fourth section 120*d*, and a fifth section 120*e* in end to end relation with other possible sections not shown. The first section 120*a* of the shielding separator 112, shown in cross section in FIG. 7, has a conductive material layer 122 positioned adjacent the first elongated divider 116*a* and the second elongated divider 116*b* facing the second wire pair 106 to reduce interference between the second wire pair and the first wire pair 104, between the second wire pair and the third wire pair 108, and between the second wire pair and the fourth wire pair 110.

The first section 120*a* of the shielding separator 112 also has a conductive material layer 124 positioned adjacent the third elongated divider 116*c* and the fourth elongated divider 116*d* facing the fourth wire pair 110 to reduce interference between the fourth wire pair and the first wire pair 104, between the fourth wire pair and the second wire pair 106, and between the fourth wire pair and the third wire pair 108. Neither the conductive material layer 122 nor the conductive material layer 124 substantially shields interference that may occur between the first wire pair 104 and the third wire pair 108 since there is limited conductive material therebetween. As depicted, the elongated center member 114 has a greater dimensional width between the first wire pair 104 and the third wire pair 108 than the dimensional width between the second wire pair 106 and the fourth wire pair 110 to compensate for this lack of conductive material between the first wire pair and the third wire pair.

The second section 120*b* of the shielding separator 112, shown in cross section in FIG. 8, has a conductive material layer 125 positioned adjacent the first elongated divider 116*a* and the fourth elongated divider 116*d* facing the first wire pair 104 to reduce interference between the first wire pair and the second wire pair 106, between the first wire pair and the third wire pair 108, and between the first wire pair and the fourth wire pair 110.

The second section 120*b* of the shielding separator 112, shown in cross section in FIG. 8, also has a conductive material layer 126 positioned adjacent the second elongated divider 116*b* and the third elongated divider 116*c* facing the third wire pair 108 to reduce interference between the third wire pair and the first wire pair 104, between the third wire pair and the second wire pair 106, and between the third wire pair and the fourth wire pair 110. Neither the conductive material layer 125 nor the conductive material layer 126 substantially shield from interference occurring between the second wire pair 106 and the fourth wire pair 110 since there is limited conductive material therebetween. As depicted, the elongated center member 114 has a greater dimensional width between the second wire pair 106 and the fourth wire pair 110 than the dimensional width between the first wire pair 104 and the third wire pair 108 to compensate for this lack of conductive material between the second wire pair and the fourth wire pair.

The adjacent sections of the shielding separator 112 alternate in use of construction with the first and second sections 120*a* and 120*b*. For example as shown in FIG. 6, the third section 120*c* and the fifth section 120*e* have the conductive material layer 122 and the conductive material layer 124 positioned and the elongated center member 114 shaped as described above for the first section 120*a* and the fourth section 120*d* has the conductive material layer 125 and the conductive material layer 126 positioned and the elongated center member 114 shaped as described above for the second section 120*b*. The sections 120 are positioned in the shielding separator 112 as described to have sections with the conductive material layer 122 and the conductive material layer 124 alternating with the sections having the conductive material layer 125 and the conductive material layer 126. This is another way for the conductive material to be other than one continuous length to prevent the shielding separator 112 from resonating like an antenna at frequencies such as 1 MHz to 1 GHz.

Figure 9:
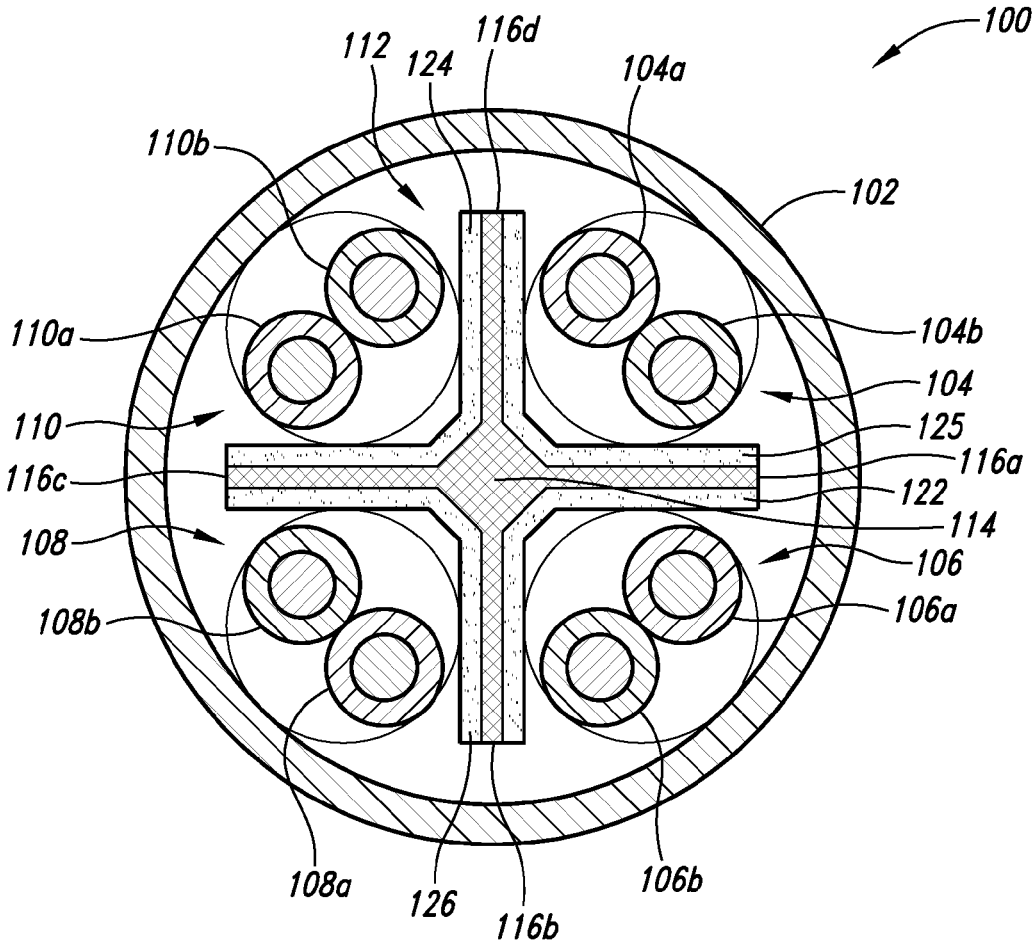
FIG. 9 is a cross-sectional view of a communication cabling system having a fourth implementation of the shielding separator.
Figure 10:
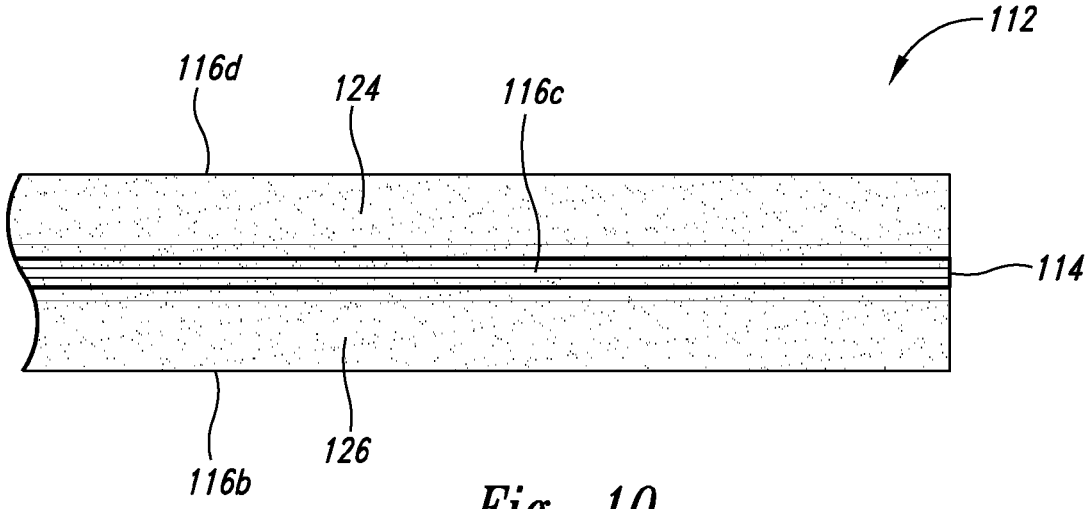
FIG. 10 is a side elevational sectional view of a section of the fourth implementation of the shielding separator.

A fourth implementation of the shielding separator 112 is shown in FIGS. 9-10 as having the elongated center member 114 and the dividing members 116 being made from a non-conductive material such as non-conductive plastic. The shielding separator 112 further includes the conductive material layer 122, the conductive material layer 124, the conductive material layer 125, and the conductive material layer 126 positioned with respect to the elongated dividing members 116 as described above for section 120*a* (shown in FIG. 7) and section 120*b* (shown in FIG. 8), respectively.

In the fourth implementation, the conductive material layers 122, 124, 125 and 126 are not alternatively positioned, but are continuous along the length of the elongated dividing members 116. Since all four of the conductive material layers are present at any given portion of the shielding separator 112, the elongated center member 114 can be symmetrically shaped without need for one dimensional width between the first wire pair 104 and the third wire pair 108 being different from the dimensional width between the second wire pair 106 and the fourth wire pair 110.

The fourth implementation is similar to the first implementation since in both, the conductive materials used are continuous through the dimensional length, L, of the cabling system 100. A variation of the fourth implementation can be similar to the second implementation in that the conductive materials are divided into sections and separated by gaps or non-conductive material in order to prevent the shielding separator 112 from resonating like an antenna at frequencies such as 1 MHz to 1 GHz.

Figure 11:
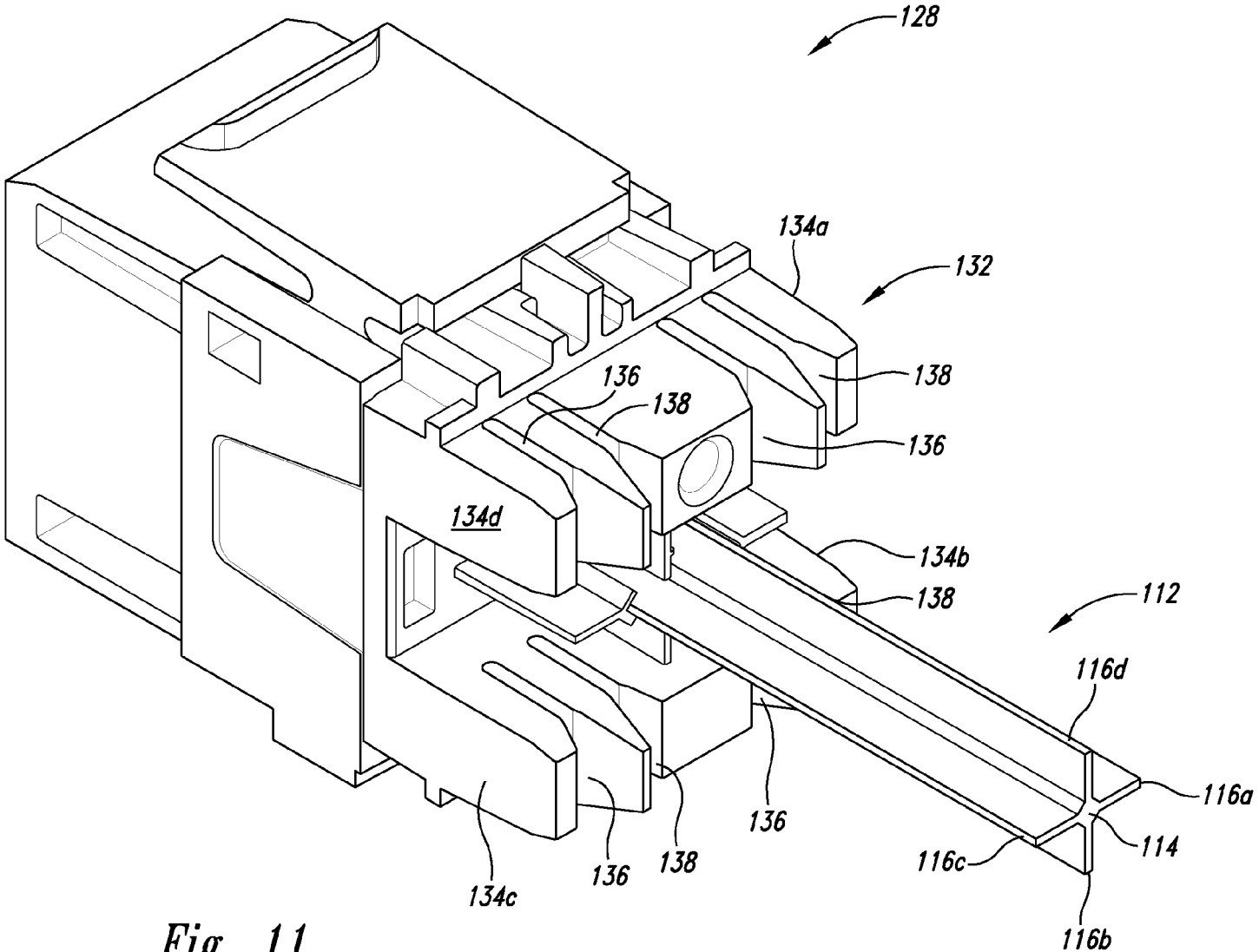
FIG. 11 is a perspective view of a connector having a section of a shielding separator extending therefrom.

An example of the shielding separator 112 used in another context is shown in FIG. 11 where the shielding separator is engaged with a connector jack 128 in the vicinity of a wire pair coupling end 132 of the connector jack where the wire pairs 103 (see FIG. 1) can be coupled to the connector jack. As shown, the coupling end 132 has a first coupling portion 134*a*, a second coupling portion 134*b*, a third coupling portion 134*c*, and a fourth coupling portion 134*d*, each having a first wire slot 136 and a second wire slot 138 to receive wires, as an example, for the first wire pair 104, the second wire pair 106, the third wire pair 108, and the fourth wire pair 110, respectively. The shielding separator 112 in FIG. 11 is depicted as having the construction of the first implementation described above, but other versions can use other of the implementations of the shielding separator.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A shielding separator for inclusion in a communication cabling, the communication cabling including a plurality of wires, the shielding separator comprising:

a center member extending along a dimensional length, wherein the center member is electrically non-conductive; and a repeating series of divider sections extending along the dimensional length concentrically disposed about and connected to the center member, each divider section comprising a plurality of dividing members extending laterally outward from the center member, each dividing member of each divider section having an electrically conductive portion opposite an electrically non-conductive portion, both the electrically conductive portion and the electrically non-conductive portion extending along the dimensional length, each of the electrically conductive portions of the dividing members of each divider section being adjacent to an electrically conductive portion of an adjacent dividing member of the same divider section, each of the electrically non-conductive portions of the dividing members of each divider section being adjacent to an electrically non-conductive portion of a different adjacent dividing member of the same divider section, the electrically conductive portions of the dividing members of each divider section being positioned out of electrical contact with the electrically conductive portions of the dividing members of the other divider sections, each dividing member positionable within the communication cabling to be between at least two of the plurality of wires.

2. The shielding separator of claim 1 wherein the electrically conductive portions of the dividing members of each divider section are positioned to define an electrically non-conductive gap between adjacent ones of the electrically conductive portions of the dividing members of the other divider sections to at least in part prevent electrical contact therebetween.

3. A shielding separator for inclusion in a communication cabling, the communication cabling including a plurality of wires, the shielding separator comprising:

a center member extending along a dimensional length;

a series of divider sections extending along the dimensional length alternating between a first type divider section and a second type divider section, each divider section comprising a first, a second, a third, and a fourth dividing member each extending laterally outward from the center member in a first, a second, a third, and a fourth orientation, respectively, and each positionable within the communication cabling to be between at least two of the plurality of wires, wherein each divider section is non-conductive;

wherein divider sections of the first type have an electrically conductive material layer adjacent to and continuously extending between portions of the first and second dividing members, but do not have an electrically conductive material layer adjacent to and continuously extending between portions of the second and third dividing members; and wherein divider sections of the second type have an electrically conductive material layer adjacent to and continuously extending between portions of the second and third dividing members, but do not have an electrically conductive material layer adjacent to and continuously between portions of the first and second dividing members;

wherein divider sections of the first type have an electrically conductive material layer adjacent to and continuously extending between portions of the third and fourth dividing members, but do not have an electrically conductive material layer adjacent to and continuously extending between portions of the first and fourth dividing members; and divider sections of the second type have an electrically conductive material layer adjacent to and continuously extending between portions of the first and fourth dividing members, but do not have an electrically conductive material layer adjacent to and continuously between portions of the third and fourth dividing members.

4. The shielding separator of claim 3 wherein the electrically conductive material layer is an electrically conductive plastic.

5. The shielding separator of claim 4 wherein the electrically conductive plastic is an extruded plastic impregnated with metal fibers.

6. The shielding separator of claim 3 wherein the center member is of an electrically non-conductive material.

7. The shielding separator of claim 6 wherein the center member extends continuously along the dimensional length.

8. The shielding separator of claim 3 wherein the first, second, third and fourth dividing members of each of the first and second type divider sections extend from the center member to form an "X" pattern.

9. The shielding separator of claim 3 wherein the center member and the first, second, third and fourth dividing members are formed as an integral unit.

10. The shielding separator of claim 3 wherein the center member and the first, second, third and fourth dividing members of each of the first and second type divider sections are co-extruded member portions of a single member.

11. A communication cabling comprising:

a sheathing having a dimensional length;

a center member extending along the dimensional length and being covered by the sheathing;

a series of divider sections extending along the dimensional length alternating between a first type divider section and a second type divider section, each divider section comprising a first, a second, a third and a fourth dividing member, each extending laterally outward from the center member in a first, a second, a third and a fourth orientation, respectively, and each positionable within the communication cabling to be between at least two of the plurality of wires, wherein each divider section is non-conductive;

wherein divider sections of the first type have an electrically conductive material layer adjacent to and continuously extending between portions of the first and second dividing members, but do not have an electrically conductive material layer adjacent to and continuously extending between portions of the second and third dividing members;

wherein divider sections of the second type have an electrically conductive material layer adjacent to and continuously extending between portions of the second and third dividing members, but do not have an electrically conductive material layer adjacent to and continuously between portions of the first and second dividing members; and a plurality of wire pairs being covered by the sheathing and being separated from one another by the first, second, third and fourth dividing members wherein divider sections of the first type have an electrically conductive material layer adjacent to and continuously extending between portions of the third and fourth dividing members, but do not have an electrically conductive material layer adjacent to and continuously extending between portions of the first and fourth dividing members; and divider sections of the second type have an electrically conductive material layer adjacent to and continuously extending between portions of the first and fourth dividing members, but do not have an electrically conductive material layer adjacent to and continuously between portions of the third and fourth dividing members.

12. The communication cabling of claim 11 wherein the electrically conductive material layer is an electrically conductive plastic.

13. The communication cabling of claim 12 wherein the electrically conductive plastic is an extruded plastic impregnated with metal fibers.

14. The communication cabling of claim 11 wherein the center member is of an electrically non-conductive material.

15. The communication cabling of claim 14 wherein the dividing members extend from the center member to form an "X" pattern.

16. The communication cabling of claim 11 wherein the center member and the dividing members are formed as an integral unit.

17. The communication cabling of claim 11 wherein the center member and the first, second, third and fourth dividing members of each of the first and second type divider sections are co-extruded member portions of a single member.

18. A shielding separator for inclusion in a communication cabling, the communication cabling including a plurality of wires, the shielding separator comprising a repeating series of divider sections extending along a dimensional length of a center portion of the shielding separator and concentrically disposed about the center portion, each divider section comprising:

a plurality of spaced apart dividing members extending radially outwardly from the center portion and defining a plurality of interstices, each interstice being configured to house a portion of the plurality of wires of the communication cabling, each dividing member of each divider section having an electrically conductive face opposite an electrically non-conductive face, each of the plurality of spaced apart dividing members being arranged to face its electrically conductive face toward the electrically conductive face of a first adjacent dividing member across a first interstice of the plurality of interstices defined between the dividing member and the first adjacent dividing member, and to face its electrically non-conductive face toward the electrically non-conductive face of a second adjacent dividing member across a second interstice of the plurality of interstices defined between the dividing member and the second adjacent dividing member, the electrically conductive faces of the dividing members of each divider section being positioned out of electrical contact with the electrically conductive faces of the dividing members of the other divider sections.

19. The shielding separator of claim 18, further comprising:

an electrically non-conductive center member extending along the dimensional length of the center portion of the shielding separator connected to the repeating series of divider sections.

20. The shielding separator of claim 19, wherein the center member extends continuously along the dimensional length.

21. The shielding separator of claim 19, wherein the electrically non-conductive center member and the electrically non-conductive faces of the dividing members of the divider sections are formed as an integral unit.

22. The shielding separator of claim 19, wherein the electrically non-conductive center member and the electrically non-conductive faces of the dividing members of the divider sections are co-extruded member portions of a single member.

23. The shielding separator of claim 18, wherein the electrically conductive face comprises an electrically conductive plastic.

24. The shielding separator of claim 23, wherein the electrically conductive plastic is an extruded plastic impregnated with metal fibers.

25. A communications cable comprising:

an elongated sheathing having an interior portion;

a plurality of wires disposed inside the interior portion of the elongated sheathing; and a shielding separator disposed inside the interior portion of the elongated sheathing, the shielding separator having a plurality of first sections alternating longitudinally with a plurality of second sections, each of the first and second sections having a plurality of outwardly extending sidewalls arranged about a longitudinally extending center portion of the interior portion of the elongated sheathing, the plurality of outwardly extending sidewalls of the first and second sections being aligned longitudinally to divide the interior portion into a plurality of longitudinally extending channels arranged in a series about the center portions of the first and second sections, selected ones of the plurality of wires extending within each of the plurality of longitudinally extending channels in the series, within the plurality of first sections, a portion of every other one of the plurality of longitudinally extending channels in the series being defined between an electrically conductive portion of a first sidewall of the plurality of outwardly extending sidewalls, and an electrically conductive portion of a second sidewall of the plurality of outwardly extending sidewalls, and within the plurality of second sections, a portion of the same every other one of the plurality of longitudinally extending channels in the series being defined between an electrically non-conductive portion of a first sidewall of the plurality of outwardly extending sidewalls, and an electrically non-conductive portion of a second sidewall of the plurality of outwardly extending sidewalls.

26. The communications cable of claim 25, wherein each of the first and second sections has a longitudinally extending center portion and the plurality of outwardly extending sidewalls of the section are arranged about the longitudinally extending center portion.

27. The communications cable of claim 26, wherein a first group of channels comprise the every other one of the plurality of longitudinally extending channels in the series, and a second group of channels comprise the other channels of the plurality of longitudinally extending channels in the series, along a first direction, the longitudinally extending center portion of the plurality of first sections separates the channels of the first group from one another, along a second direction, the longitudinally extending center portion of the plurality of first sections separates the channels of the second group from one another, the longitudinally extending center portion of the plurality of first sections has a first width along the first direction and a second width along the second direction, the first width being less than the second width.

28. The communications cable of claim 27, wherein the longitudinally extending center portion of the plurality of second sections has a third width along the first direction and a fourth width along the second direction, the third width being greater than the fourth width.

29. A shielding separator for inclusion in a communication cable, the communication cable including an interior portion having a plurality of wires, the shielding separator comprising:

a first section having four dividing members arranged to form an X-type shape and to divide the interior portion of a cable into a first set of four regions, a first region of the first set of four regions being opposite a second region of the first set of four regions, and a third region of the first set of four regions being opposite a fourth region of the first set of four regions; and a second section having four dividing members arranged to form an X-type shape and to divide the interior portion of a cable into a second set of four regions, the four dividing members of the second section being aligned with the four dividing members of the first section, a fifth region of the second set of four regions being opposite a sixth region of the second set of four regions, and a seventh region of the second set of four regions being opposite an eighth region of the second set of four regions, the fifth region of the second section being contiguous with the first region of the first section, the sixth region of the second section being contiguous with the second region of the first section, the seventh region of the second section being contiguous with the third region of the first section, the eighth region of the second section being contiguous with the fourth region of the first section, portions of the first section defining the first and second regions being electrically conductive and portions of the first section defining the third and fourth regions being electrically non-conductive portions of the second section defining the fifth and sixth regions being electrically non-conductive and portions of the second section defining the seventh and eight regions being electrically conductive.

30. The shielding separator of claim 29 wherein the first section of the shielding separator has a central portion that spaces the third and fourth regions farther apart from one another than the first and second regions are spaced apart, and the second section of the shielding separator has a central portion that spaces the fifth and sixth regions farther apart from one another than the seventh and eighth regions are spaced apart.

* * * * *